United States Patent [19]

Riggle

[11] Patent Number: 4,512,046

[45] Date of Patent: Apr. 23, 1985

[54] TOILET GUARD

[76] Inventor: Rita C. Riggle, P.O. Box 19, San Gregorio, Calif. 94074

[21] Appl. No.: 472,617

[22] Filed: Mar. 7, 1983

[51] Int. Cl.[3] ..... A47K 13/10; A47K 17/00

[52] U.S. Cl. ..... 4/661; 4/251

[58] Field of Search ..... 4/661, 251, 236, 234

[56] References Cited

U.S. PATENT DOCUMENTS 1,999,555 4/1935 Adams ..... 4/251

2,758,315 8/1956 Hylton ..... 4/251

3,717,884 2/1973 Mantooth ..... 4/251 X

*Primary Examiner*—Henry K. Artis

*Attorney, Agent, or Firm*—Willis E. Higgins

[57] ABSTRACT

An attachment (10) mounted on underside (16) of a toilet (14) lid (12) has a covering end (18) dimensioned and configured to extend over a flushing handle (20) of the toilet (14). The attachment (10) serves as a guard to prevent the toilet (14) from being flushed without lowering lid (12) to rest on seat (22). A hazard to small children from an open toilet bowl of the toilet (14) is therefore eliminated.

6 Claims, 2 Drawing Figures

TOILET GUARD

BACKGROUND OF THE INVENTION

This invention relates to a safety device to help insure the closing of toilet lids. More particularly, it relates to such a device which will interfere with flushing of a toilet when the lid is in its raised position.

DESCRIPTION OF THE PRIOR ART

The desirability of insuring that a toilet lid is left in its closed position, for both safety and appearance reasons, is recognized in the prior art. The significant safety hazard of an open toilet bowl to small children has long been recognized. A variety of devices for insuring that the lid is closed after use are therefore known. For example, U.S. Pat. No. 3,781,924 discloses a pneumatically operated mechanism for lowering a toilet lid during a flushing cycle. U.S. Pat. Nos. 1,863,682; 1,224,734 and 3,590,397 all disclose various mechanisms for actuating the flushing cycle of a toilet by closing the lid. U.S. Pat. No. 4,195,372 discloses a spring mechanism for returning a toilet seat to its lowered position after lifting.

Various other toilet seat and lid structures are also known in the art. For example, U.S. Pat. Nos. 1,999,555 and 2,758,315, respectively, disclose handles for lifting a toilet seat and a toilet lid. U.S. Pat. No. 3,921,235 discloses a toilet seat which blocks a flushing handle when the seat is raised, but the lid in that patent does not block the handle.

A review of the above prior art shows that the structures provided which insure closing a toilet lid after use of the toilet are either complex devices or are not readily incorporated for use with existing toilet lids. A need therefore remains for a simple device which is readily installed on existing toilets to insure closing the toilet lid after use.

SUMMARY OF THE INVENTION

Accordingly, it is an object of this invention to provide a safety device for preventing access to a toilet flushing handle without closing a toilet lid.

It is another object of the invention to provide such a safety device which is adapted for easy installation on conventional toilets.

It is further object of the invention to provide such a safety device which serves its intended purpose without otherwise interfering with conventional positioning of a toilet lid.

The attainment of the foregoing and related objects may be achieved through use of the novel attachment for a toilet lid of this invention. A toilet lid attachment in accordance with this invention insures closing the lid after use of the toilet. The attachment is a member dimensioned and configured at one end to cover a flushing handle for the toilet when the lid is in a raised position. The member has a second end remote from the covering end for attaching the member to the lid so that the covering end extends from the lid to cover the flushing handle when the lid is in the raised position. The covering end preferably has a concave surface which extends around the flushing handle when the lid is in the raised position. The attaching end preferably has a sufficient thickness to space a portion of the member extending between the attaching end and the covering end between an underside of the lid and a seat on the toilet.

In operation, the attachment of this invention prevents a user from reaching the flushing handle until the toilet lid is moved away from its raised position against the toilet tank. Once the user has moved the lid in order to reach the flushing handle, the lid has been started in a downward motion, and the user will close the lid rather than return it to the completely raised position. Access to the toilet bowl by small children will therefore be prevented.

The attainment of the foregoing and related objects, features and advantages of the invention should be more readily apparent to those skilled in the art, after review of the following more detailed description of the invention, taken together with the drawings, in which:

BRIEF DESCRIPTION

DETAILED DESCRIPTION OF THE INVENTION

Figure 1:
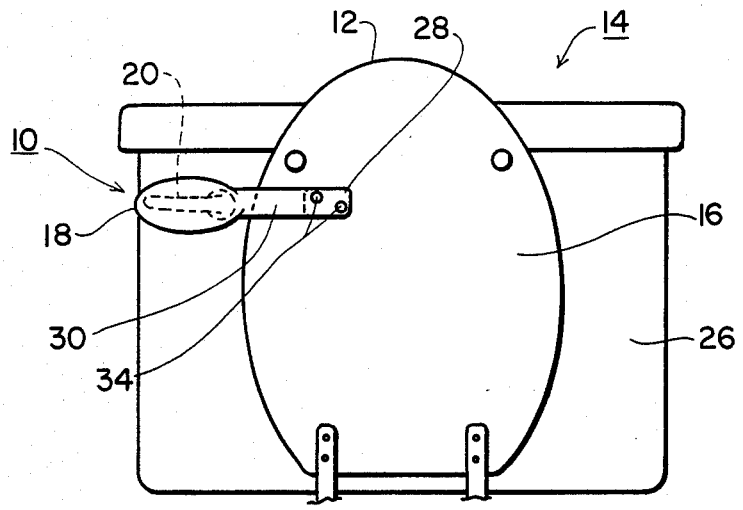
FIG. 1 is a front view of a toilet with the invention in place.
Figure 2:
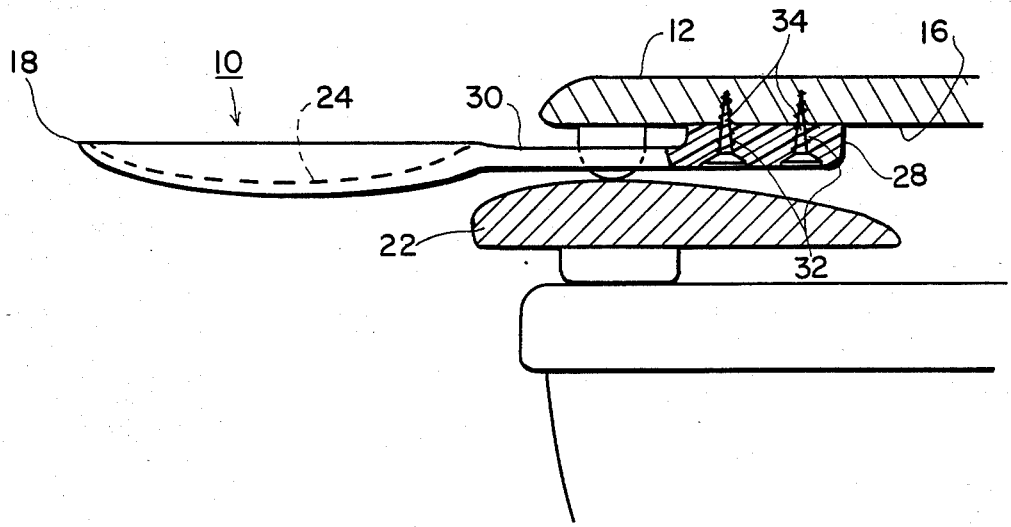
FIG. 2 is a partial cross section view of a portion of the toilet in FIG. 1 with the invention in place.

Turning now to the drawings, more particularly to FIG. 1, a safety device attachment 10 in accordance with the invention is shown installed on a lid 12 of toilet 14. The attachment 10 is mounted on underside 16 of the lid 12 so that end 18 extends laterally from the lid 12. End 18 extends a sufficient distance from the lid 12 and is shaped to cover flushing handle 20 of the toilet 14. Thus, when the lid 12 is in its raised position as shown, the attachment 10 prevents a user of the toilet 14 from reaching handle 20 without beginning to move the lid 12 toward its lowered position on seat 22 (FIG. 2). A user of the toilet 14 will therefore be highly unlikely to leave the lid 12 in its raised position because of the inconvenience of doing so while flushing the toilet. The user will quickly learn to close the lid after each use in order to remove the blocking attachment 10 from the handle 20 in the most convenient manner.

Further details of the attachment 10 are shown in FIG. 2, in which the lid 12 is in its lowered position, resting on seat 22. End 18 of the attachment 10 has a concave surface 24 which extends around the handle 20 when lid 12 is in its raised position, resting against tank 26 (FIG. 1). End 28 of the attachment 10 has a sufficient thickness so that portion 30 extending between end 28 and covering end 18 passes between the lid 12 and the seat 22, without interfering with the normal position of lid 12 on top of seat 22. End 28 has apertures 32 extending through the end 28 for receiving fastening screws 34 to mount the attachment 10 on underside 16 of lid 12.

While the attachment 10 may be fabricated, for example, from any suitable metal or plastic, it is preferred to form it from a flexible plastic material, such as polyethylene or polypropylene. In this form, the attachment 10 will bend if a person pushes against it, rather than break and/or possibly cause injury. The polyethylene or polypropylene may be molded or cast to form the attachment 10. Decorative colors and patterns may be provided for the attachment, if desired.

It should now be readily apparent to those skilled in the art that a safety attachment for a toilet lid capable of achieving the stated objects of the invention has been provided. The attachment blocks access to a toilet flushing handle when the toilet lid is in its raised position. The attachment is simple in construction and readily installed on existing toilets. Other than assuring that the user closes the toilet lid after use of the toilet lid after use of the toilet in order to flush conveniently, the attachment does not interfere with conventional toilet operation. As a result, the attachment of this invention will significantly reduce the hazard from a toilet to small children.

It should further be apparent to those skilled in the art that various changes in form and details of the invention as shown and described may be made. It is intended that such changes be included within the spirit and scope of the claims appended thereto.

What is claimed is:

1. A combination to prevent flushing a toilet without closing a lid of the toilet, which comprises a toilet lid, a toilet seat and an attachment for said toilet lid to insure closing said lid after use of the toilet, which attachment comprises a member dimensioned and configured at one end to cover a flushing handle for the toilet when said lid is in a raised position, and a second end remote from said covering end attaching said member to said lid so that said covering end extends from said lid and beyond an edge of said toilet seat on the same side thereof as the flushing handle to cover the flushing handle when said lid is in the raised position.

2. The combination of claim 1 in which said covering end has a concave surface which extends around the flushing handle when said lid is in the raised position.

3. The combination of claim 1 in which said attaching end has a sufficient thickness to space a portion of said member extending between said attaching end and said covering end between an underside of said lid and said toilet seat.

4. The combination of claim 3 in which said attaching end has a plurality of apertures through which fasteners extend to attach the attachment to the underside of said lid.

5. The combination of claim 1 in which said attachment is formed of a flexible material.

6. The combination of claim 5 in which the flexible material is polyethylene or polypropylene plastic.

* * * * *